US011134339B2

(12) United States Patent
Dick et al.

(10) Patent No.: US 11,134,339 B2
(45) Date of Patent: Sep. 28, 2021

(54) ASYMMETRIC MICROPHONE ARRAY FOR SPEAKER SYSTEM

(71) Applicant: Bose Corporation, Framingham, MA (US)

(72) Inventors: David Avi Dick, Marlborough, MA (US); Sarah Margaret Heile, Hudson, MA (US)

(73) Assignee: BOSE CORPORATION, Framingham, MA (US)

( * ) Notice: Subject to any disclaimer, the term of this patent is extended or adjusted under 35 U.S.C. 154(b) by 136 days.

(21) Appl. No.: 16/244,636

(22) Filed: Jan. 10, 2019

(65) Prior Publication Data

US 2019/0149913 A1 May 16, 2019

Related U.S. Application Data

(63) Continuation of application No. 15/799,021, filed on Oct. 31, 2017, now Pat. No. 10,349,169.

(51) Int. Cl.
*H04R 3/00* (2006.01)
*H04R 1/40* (2006.01)
(Continued)

(52) U.S. Cl.
CPC ..... *H04R 1/406* (2013.01); *H04R 1/02* (2013.01); *H04R 1/265* (2013.01); *H04R 3/005* (2013.01);
(Continued)

(58) Field of Classification Search
CPC ..... H04R 1/406; H04R 1/02; H04R 1/265; H04R 3/005; H04R 5/027;
(Continued)

(56) References Cited

U.S. PATENT DOCUMENTS 7,269,263 B2 * 9/2007 Dedieu ..... H04R 1/406 381/91
7,792,313 B2 * 9/2010 Dedieu ..... G01S 3/8006 381/92
(Continued)

FOREIGN PATENT DOCUMENTS

CN 101548554 A 9/2009
CN 102708874 A 10/2012
(Continued)

OTHER PUBLICATIONS

International Search Report and Written Opinion for International Application No. PCT/US2018/057480, dated Dec. 19, 2018, 13 pages.

*Primary Examiner* — Disler Paul
(74) *Attorney, Agent, or Firm* — Hoffman Warnick LLC

(57) ABSTRACT

Various implementations include microphone arrays and related speaker systems. In one implementation, a microphone array is mounted in a housing having a primary X axis, a primary Y axis perpendicular to the primary X axis, and a primary Z axis perpendicular to the primary X axis and the primary Y axis. The microphone array can include: a set of microphones positioned in a single plane perpendicular to the primary Z axis of the housing and axially asymmetric with respect to both the primary X axis of the housing and the primary Y axis of the housing. In some cases, all microphones in the set of microphones are stationary relative to the housing.

15 Claims, 11 Drawing Sheets

(51) Int. Cl.
*H04R 1/02* (2006.01)
*H04R 1/26* (2006.01)
*H04R 5/027* (2006.01)

(52) U.S. Cl.
CPC ..... *H04R 5/027* (2013.01); *H04R 2201/401* (2013.01); *H04R 2201/403* (2013.01); *H04R 2201/405* (2013.01)

(58) Field of Classification Search
CPC ..... H04R 2201/401; H04R 2201/403; H04R 2201/405; H04R 1/326; H04R 29/005
USPC ..... 381/91–92, 122
See application file for complete search history.

(56) References Cited

U.S. PATENT DOCUMENTS 8,868,413 B2 10/2014 Siotis
9,479,627 B1 * 10/2016 Rung ..... H04M 1/035
9,659,577 B1 5/2017 Langhammer
9,812,128 B2 11/2017 Mixter et al.
2003/0112984 A1 6/2003 Graumann
2004/0120532 A1 6/2004 Dedieu et al.
2005/0058300 A1 * 3/2005 Suzuki ..... H04R 27/00 381/92
2011/0019857 A1 1/2011 Matsui
2011/0137109 A1 * 6/2011 Zahnert ..... H04R 25/606 600/25
2012/0019689 A1 1/2012 Zurek et al.
2012/0259628 A1 10/2012 Siotis
2017/0188141 A1 * 6/2017 Rung ..... H04R 3/005
2017/0263268 A1 9/2017 Rumberg et al.
2018/0206039 A1 * 7/2018 Vilermo ..... H04R 1/406
2018/0352324 A1 * 12/2018 Choisel ..... H04R 1/403

FOREIGN PATENT DOCUMENTS

CN 102860039 A 1/2013
CN 104412616 A 3/2015
EP 2981097 A1 2/2016

* cited by examiner

ASYMMETRIC MICROPHONE ARRAY FOR SPEAKER SYSTEM

CROSS-REFERENCE TO RELATED APPLICATION

This application is a continuation filing that claims priority to U.S. patent application Ser. No. 15/799,021, filed on Oct. 31, 2017, which is hereby incorporated by reference in its entirety.

TECHNICAL FIELD

This disclosure generally relates to microphone arrays. More particularly, the disclosure relates to a microphone array for a speaker system, such as a voice-enabled speaker system.

BACKGROUND

Voice-enabled devices such as speaker systems (also referred to as, "smart speakers") are increasingly present in homes, offices and other environments. These devices allow users to control various functions using voice commands. However, given their portability and size, it can be challenging to configure microphones in these devices to effectively process vocalized user input.

SUMMARY

All examples and features mentioned below can be combined in any technically possible way.

Various implementations include a microphone array for a speaker system. In some implementations, the microphone array has an asymmetric configuration of microphones.

In some particular aspects, a microphone array is mounted in a housing having a primary X axis, a primary Y axis perpendicular to the primary X axis, and a primary Z axis perpendicular to the primary X axis and the primary Y axis. The microphone array can include: a set of microphones positioned in a single plane perpendicular to the primary Z axis and axially asymmetric with respect to both the primary X axis and the primary Y axis.

In other particular aspects, a system includes: a speaker housing having a primary X axis, a primary Y axis perpendicular to the primary X axis, and a primary Z axis perpendicular to the primary X axis and the primary Y axis; and a microphone array contained within the speaker housing, the microphone array having a set of microphones positioned in a single plane perpendicular to the primary Z axis and axially asymmetric with respect to both the primary X axis and the primary Y axis.

In additional particular aspects, a microphone array is mounted in a housing having a primary X axis, a primary Y axis perpendicular to the primary X axis, and a primary Z axis perpendicular to the primary X axis and the primary Y axis. The microphone array can include: a set of microphones positioned in a single plane perpendicular to the primary Z axis of the housing and axially asymmetric with respect to both the primary X axis of the housing and the primary Y axis of the housing, where all microphones in the set of microphones are stationary relative to the housing.

In other particular aspects, a system includes: a speaker housing having a primary X axis, a primary Y axis perpendicular to the primary X axis, and a primary Z axis perpendicular to the primary X axis and the primary Y axis; and a microphone array contained within the speaker housing. The microphone array can include a set of microphones positioned in a single plane perpendicular to the primary Z axis of the housing and axially asymmetric with respect to both the primary X axis of the housing and the primary Y axis of the housing, where all microphones in the set of microphones are stationary relative to the housing.

In additional particular aspects, a system includes: a speaker housing having a primary X axis, a primary Y axis perpendicular to the primary X axis, and a primary Z axis perpendicular to the primary X axis and the primary Y axis; and a microphone array contained within the speaker housing. The microphone array includes: a set of microphones positioned in a single plane perpendicular to the primary Z axis of the housing and axially asymmetric with respect to both the primary X axis of the housing and the primary Y axis of the housing. The system further includes: a printed wiring board coupled with the set of microphones; and a core section contained within the speaker housing, where the printed wiring board is coupled with the core, and where the core includes a set of recesses each at least partially housing one of the set of microphones.

Implementations may include one of the following features, or any combination thereof.

In some cases, the set of microphones is rotationally symmetric about the Z axis.

In certain implementations, the set of microphones is rotationally asymmetric about the Z axis.

In particular cases, the microphone array includes a printed wiring board coupled to the set of microphones.

In some implementations, the set of microphones includes at least two microphones. In certain cases, the set of microphones includes six microphones.

In particular cases, a cross-section of the housing along the single plane is a non-circular shape. In certain implementations, the cross-section of the housing along the single plane has a substantially rectangular shape.

In some cases, the set of microphones yields beams with a directivity index substantially equal to a directivity index of beams from a reference set of microphones positioned symmetrically about a perimetric boundary line with respect to the housing.

In certain implementations, the speaker system further includes a core section contained within the speaker housing, where the printed wiring board is coupled with the core, and the core includes a set of recesses each at least partially housing one of the set of microphones. In some cases, the printed wiring board is located between the set of microphones and a top section of the speaker housing, and the printed wiring board further includes a set of apertures extending therethrough for receiving the set of microphones. In particular implementations, the speaker system also includes an acoustically transparent screen between the printed wiring board and the top section of the speaker housing.

In some aspects, the housing has an ellipsoidal cross-section having length along the primary X axis that is distinct from a length along the primary Y axis.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
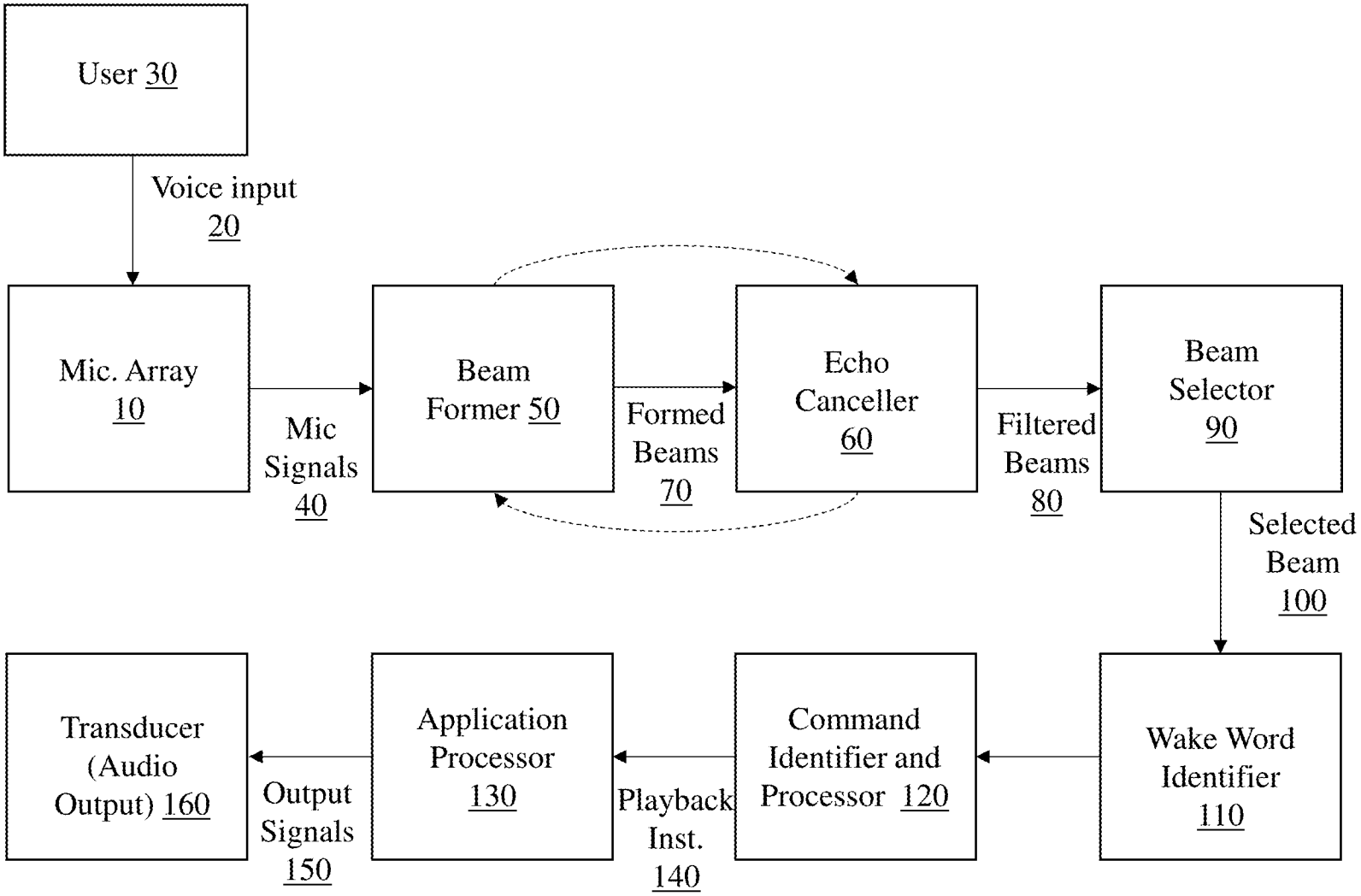
FIG. 1 is schematic data flow diagram illustrating processes performed by a speaker system according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that an asymmetric microphone array can be beneficially incorporated into a speaker system. For example, an array of microphones can be positioned asymmetrically relative to a speaker housing to provide a directivity index substantially equal to a symmetric array having a greater number of microphones. The array of microphones can be positioned to enhance the directivity index of several beams with different look directions. In various implementations, microphone arrays are located in a speaker housing having a horizontal cross-section that is non-circular in shape.

Commonly labeled components in the FIGURES are considered to be substantially equivalent components for the purposes of illustration, and redundant discussion of those components is omitted for clarity.

A microphone array, e.g., in a speaker system such as a voice-enabled speaker system, can include a set of microphones arranged to detect voice commands from a user. FIG. 1 shows a schematic data flow diagram illustrating processes in detecting and processing an audio command according to various implementations. As described herein, microphone arrays and speaker systems according to various implementations can be configured to perform one or more of the processes illustrated in FIG. 1.

In the data flow of FIG. 1, a microphone array 10 receives a voice input 20, e.g., from a user 30 (such as a human user or a distinct user such as a computer-implemented voice control system). The voice input 20 can include a command to perform a function (e.g., to search for an answer to a question, play a requested song or set a timer). The voice input 20 can also include a "wake word" or similar cue to indicate that the input includes the command. In some cases, the voice-enabled speaker system is programmed to use one or more terms or phrases as wake word(s), e.g., "Alexa," or "Siri." The voice input 20 is received at the microphone array 10, and microphone signals 40 from the array 10 are processed by one or both of a beam former 50 and an echo canceller 60.

In some cases, as depicted in phantom, the microphone signals 40 can be initially processed by the echo canceller 60 and subsequently processed by the beam former 50, however, in this example depiction, those microphone signals 40 are initially sent to the beam former 50. The beam former 50 can be configured to filter particular microphone signals 40 according to the configuration of the array 10 in order to achieve a desired directionality. Formed beams 70 are sent from the beam former 50 to the echo canceller 60 in order to remove self-playback from the microphone signals 40 or the formed beams 70. These filtered beams 80 are then sent to a beam selector 90 in order to select the beam attributable to the voice input 20 from the user 30. This selected beam 100 is then processed by the wake word identifier 110 to determine whether the voice input 20 includes that wake word (e.g., "Alexa" or "Siri"). After determining that the voice input 20 includes the correct wake word (or phrase), a command identifier and processor 120 can parse and/or analyze the selected beam 100 from the voice input 20 for one or more particular commands (e.g., "play songs by the band 'Boston'") and identify an appropriate response (e.g., by playing the first song listed alphabetically in a list of stored songs by the artist "Boston"). An application processor 130 can receive playback instructions 140 from the command identifier and processor 120, and provide output signals 150 to a transducer 160 (e.g., via digital signal processor, not shown) for providing an audio output, such as audio content or a voice response (e.g., back to user 30).

It is understood that one or more of the above-noted functions described with reference to FIG. 1 can be performed at a speaker system according to various implementations, but that one or more of these functions can be performed at a remote system (e.g., cloud-based or distributed computing system). For example, in some implementations, the processor 120 (e.g., via a transceiver such as a WiFi or LTE transceiver) can transmit audio (e.g., processed voice input 20) to a cloud-based voice service (e.g., in a real-time stream). This cloud-based voice service can convert the audio into commands that may be interpreted to provide a corresponding response back to the system speaker. Additionally, in some examples, processes such as wake word identification (e.g., by wake word identifier 110) can be performed locally at a speaker system, while other related processes such as command identification (e.g., by command identifier and processor 120) can be performed at a remote system.

Figure 2:
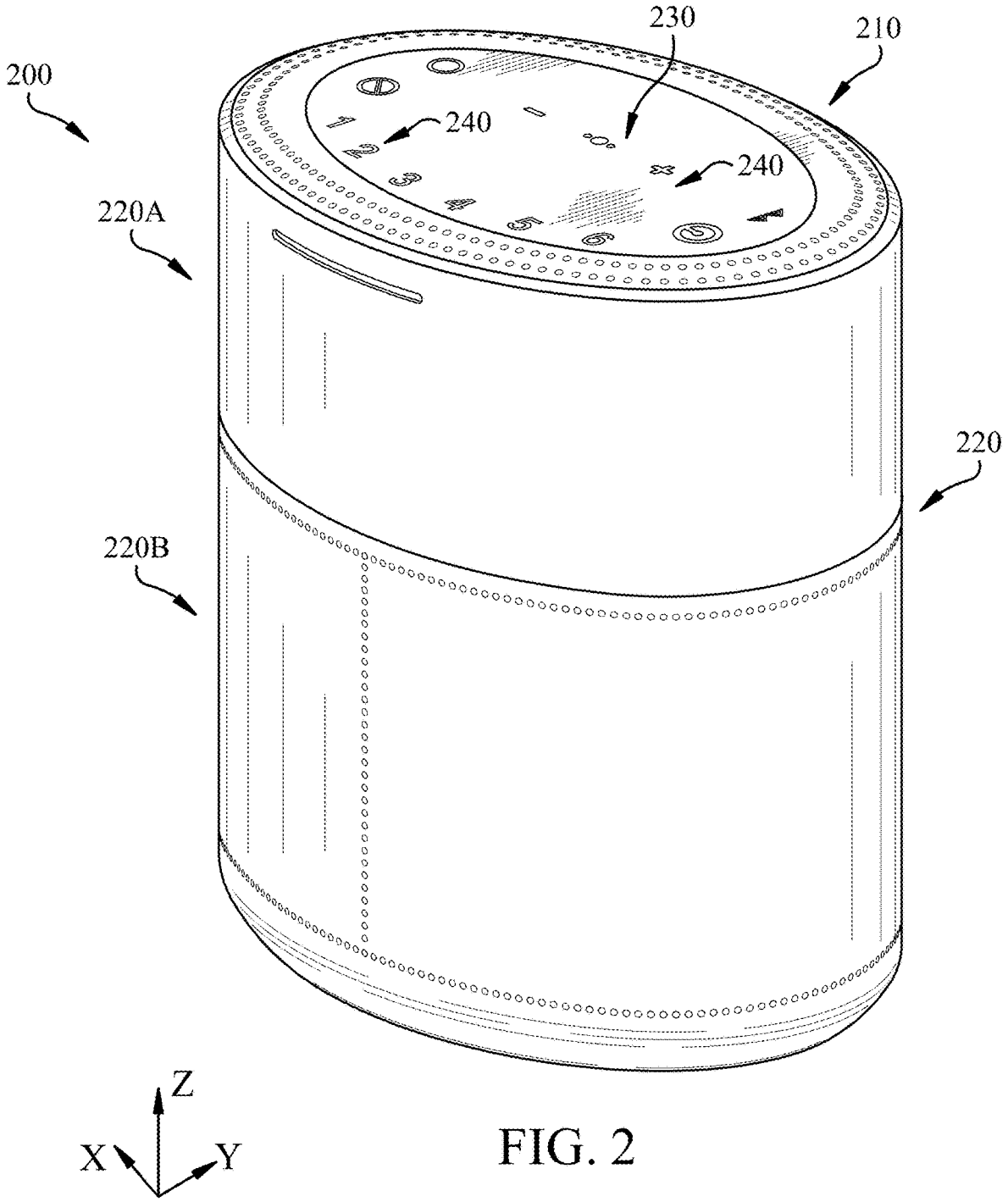
FIG. 2 shows a perspective view of a speaker system according to various implementations.
Figure 3:
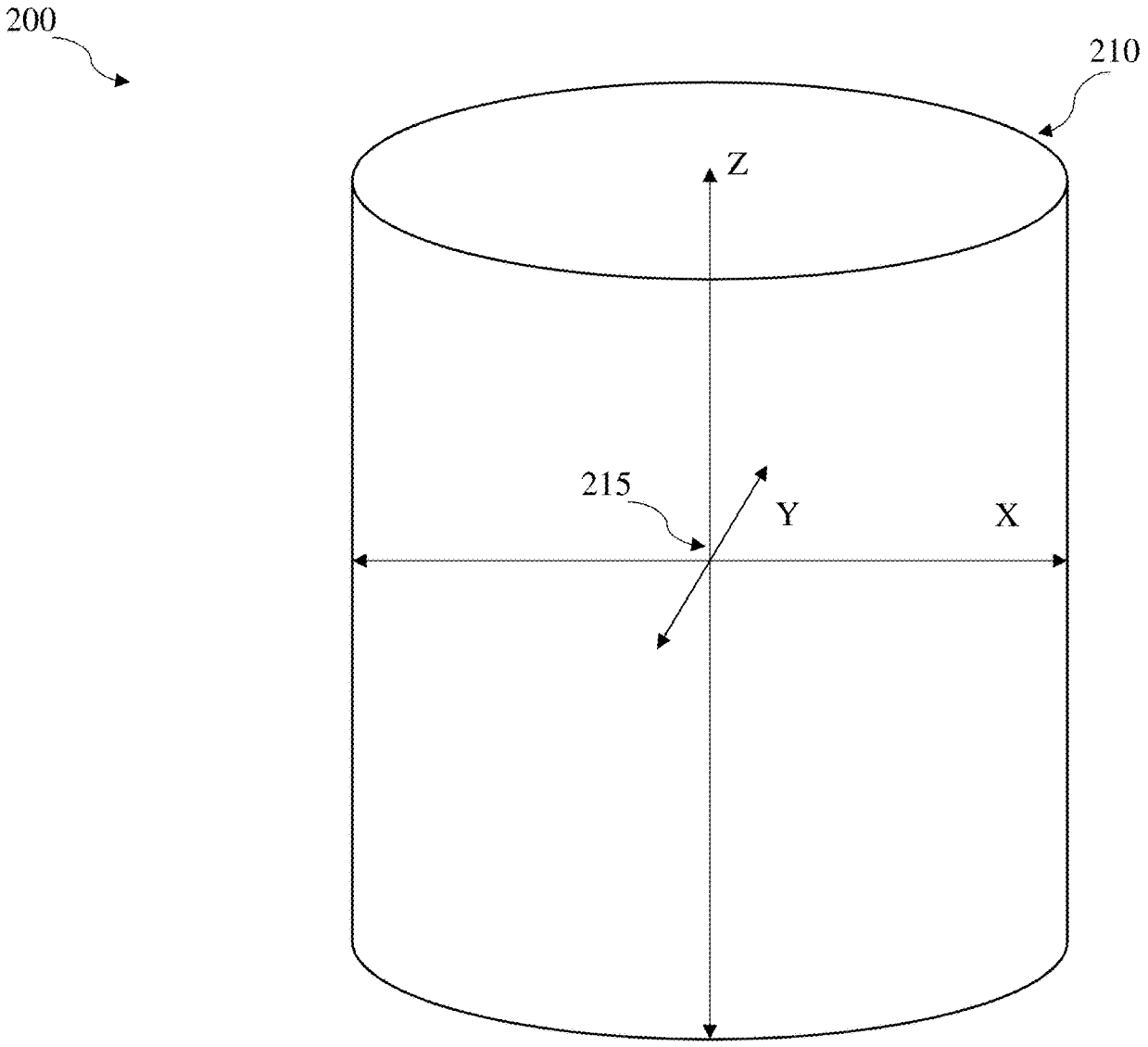
FIG. 3 shows a skeletal view of an additional perspective of the speaker system of FIG. 2.

FIG. 2 shows a perspective view of an example speaker system 200 according to various implementations. As will be described further herein, speaker system 200 can include a microphone array, such as the microphone array 10 described functionally with respect to FIG. 1. FIG. 3 shows a skeletal view of the speaker system 200 depicted in FIG. 2. With reference to FIG. 2 and FIG. 3, the speaker system 200 can include a housing 210 having a primary X axis, a primary Y axis perpendicular to the primary X axis, and a primary Z axis perpendicular to the primary X axis and the primary Y axis. FIG. 2 shows a corner perspective view of the housing 210, illustrating the orientation of the X, Y and Z axes, while FIG. 3 shows a side perspective of the skeleton of housing 210, illustrating the location of the primary axes X, Y and Z. These primary axes intersect the approximate center point 215 of the housing 210, as shown in FIG. 3.

As seen in FIG. 2, the housing 210 can be formed from one or more sections 220, such as an upper section 220A and a lower section 220B. These sections 220 can be formed of metal, plastic, composite or other conventional material used in speaker systems, and in some particular cases, may be formed at least partially of aluminum and/or plastic. In some implementations, the lower section 220B is configured to rest on a surface (desk, table, floor, etc.) and the upper section 220A is configured to house the microphone array 10 (FIG. 1) for receiving voice input from the user 20 (FIG. 1). The upper section 220A can also include an interface 230 permitting the user 20 to select one or more commands (e.g., control buttons 240).

It is understood that the terms "upper" and "lower" are merely intended to provide examples of relative positional information in one configuration of a speaker system. These terms can be interchanged, and may refer to distinct portions of a speaker system, depending upon its orientation and intended use. As such, they are not intended to be limiting to particular orientations.

Figure 4:
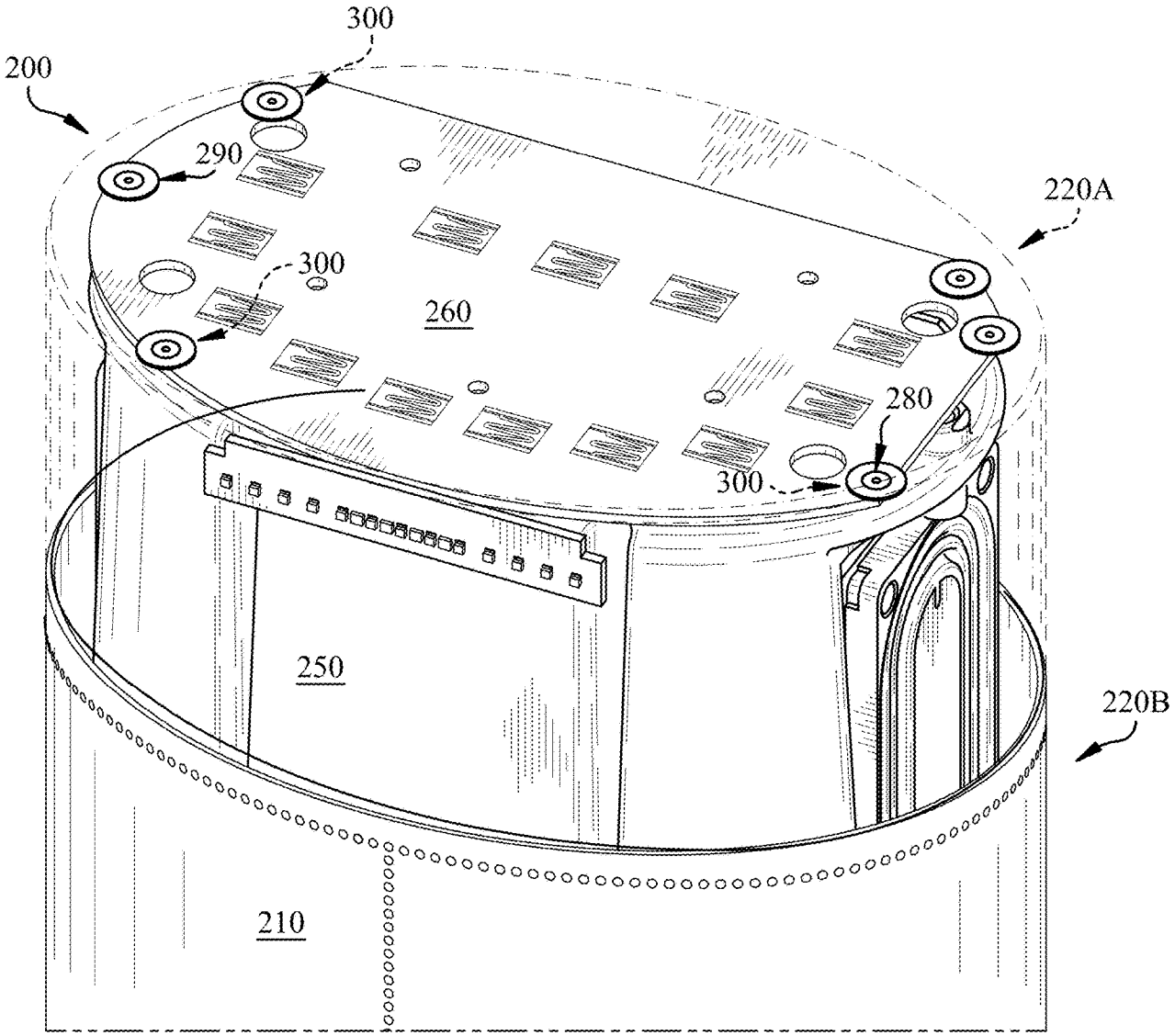
FIG. 4 shows a partially transparent view of the speaker system of FIG. 2.
Figure 5:
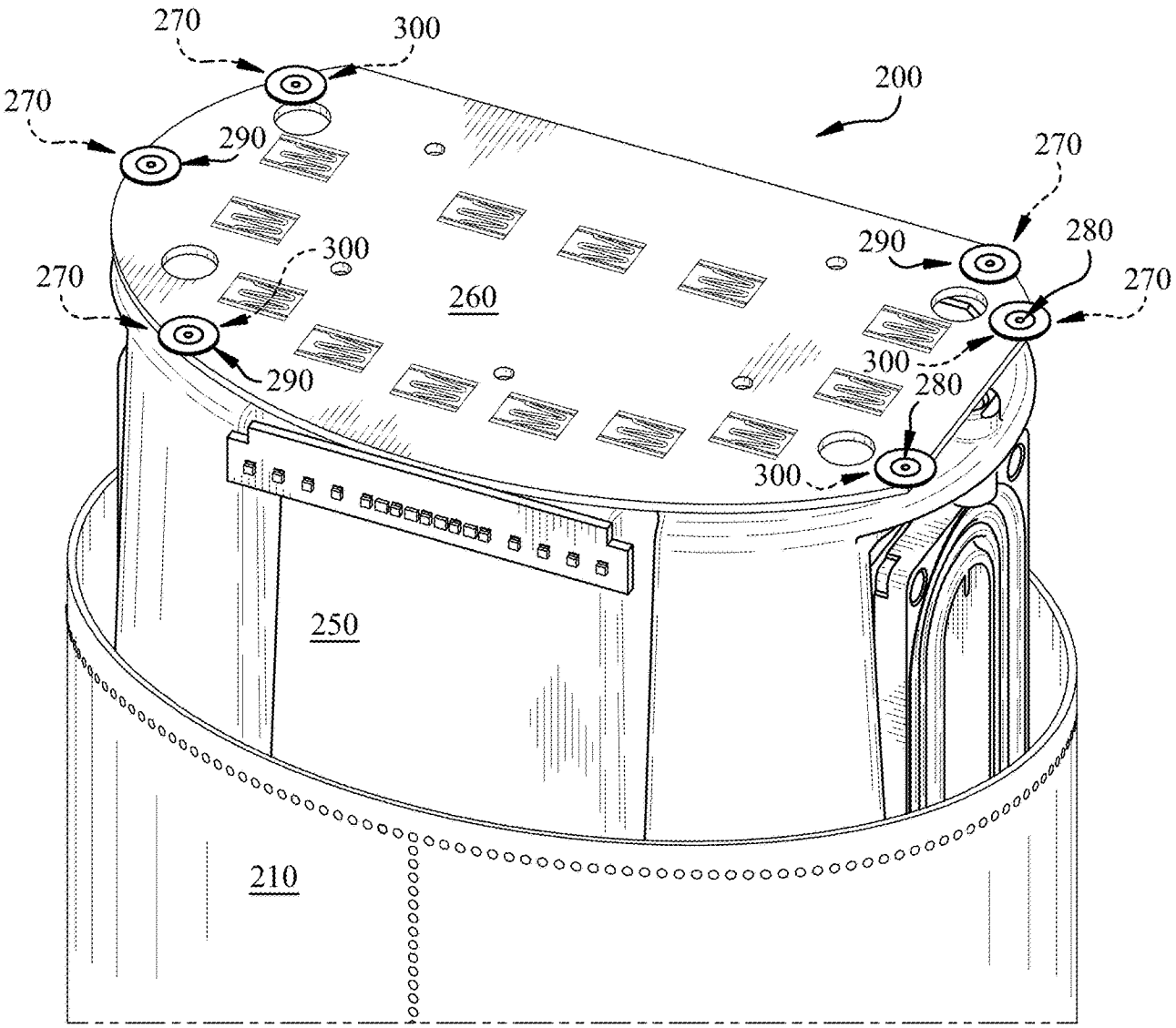
FIG. 5 shows a partial cut-away view of the speaker system of FIG. 4.
Figure 6:
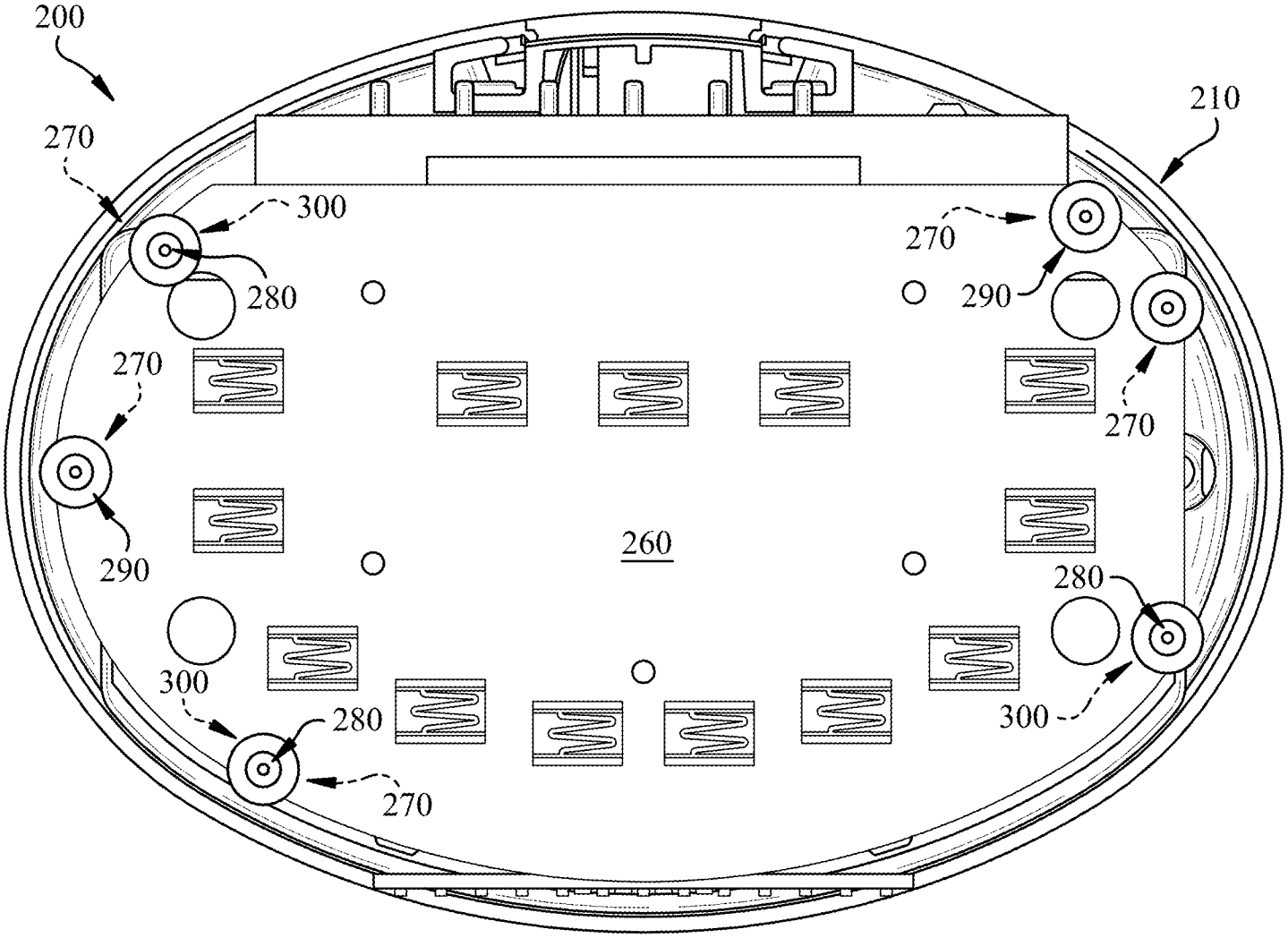
FIG. 6 shows a schematic top view of the speaker system of FIGS. 4 and 5.

FIGS. 4-6 illustrate views of the example speaker system 200 of FIGS. 2 and 3. In particular, FIG. 4 illustrates a partially transparent upper section 220A (indicated by phantom reference line), revealing a core section 250 contained within the housing 210. The core section 250 can include various components described with respect to FIG. 1, e.g., the beam former 50, echo canceller 60, beam selector 90, digital signal processor 130 and/or transducer(s) 160. Additional wiring and conventional speaker components can also be included in the core section 250.

Overlying the core section 250, as shown more clearly in FIGS. 5 and 6, is the microphone array 10 (FIG. 1) including a printed wiring board 260, which can be coupled with the core section 250 and/or the upper section 220A (via conventional couplers such as screws, bolts, pins, fasteners, male/female mating protrusions/slots, etc.) The printed wiring board 260 can include circuitry for processing the inputs from a set of microphones in the microphone array 10 (FIG. 1). In these views, the microphones in the array 10 are obstructed by the printed wiring board 260. These views (in particular, FIGS. 5 and 6) show the location of a set of apertures 270 extending through the printed wiring board 260 and corresponding with the microphones in the array 10. The apertures 270 are shown covered with an acoustically transparent screen 280 (e.g., a material such as Saatifil Acoustex 145, available from the Saati Company, Via Milano, Italy) and a gasket 290 for retaining the acoustically transparent screen 280 in place over the aperture 270.

Figure 7:
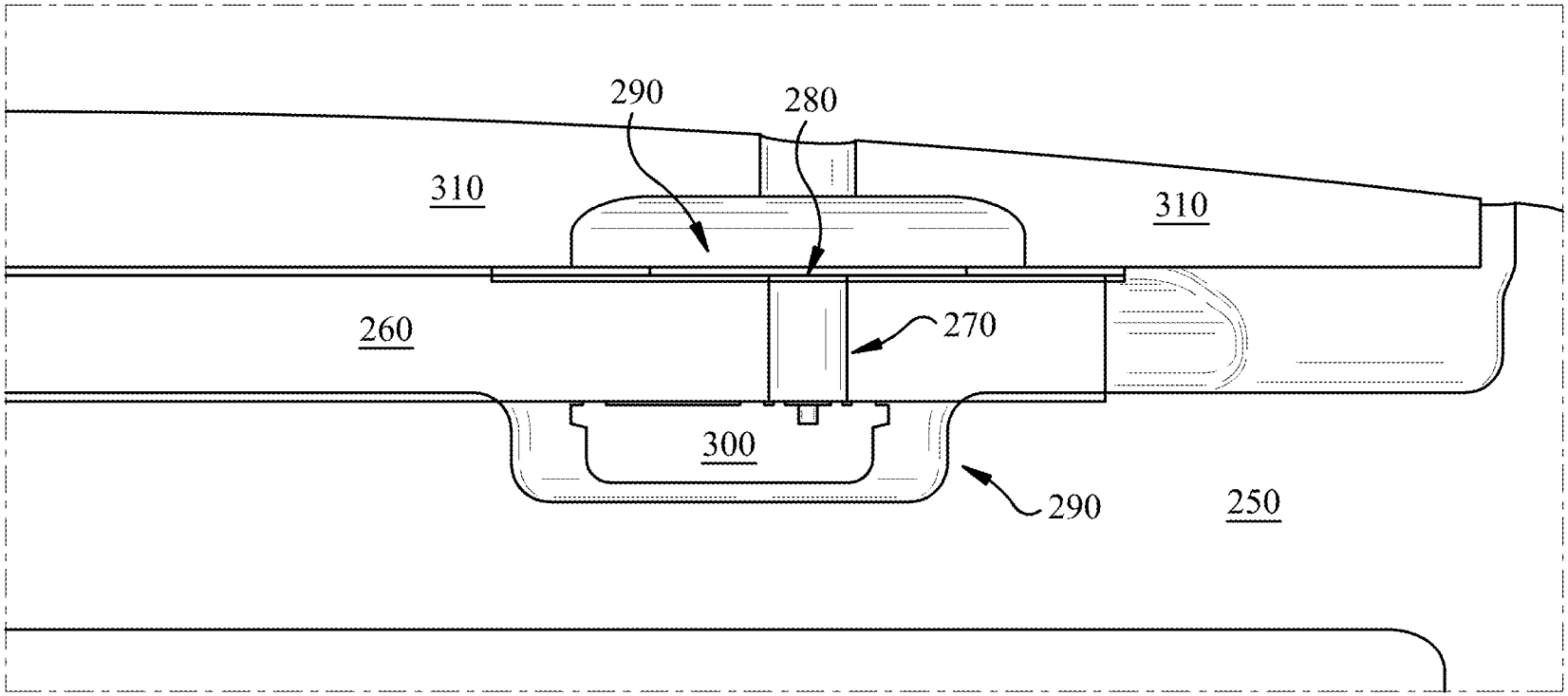
FIG. 7 shows a cross-sectional view through a portion of the speaker system of FIG. 2.
Figure 8:
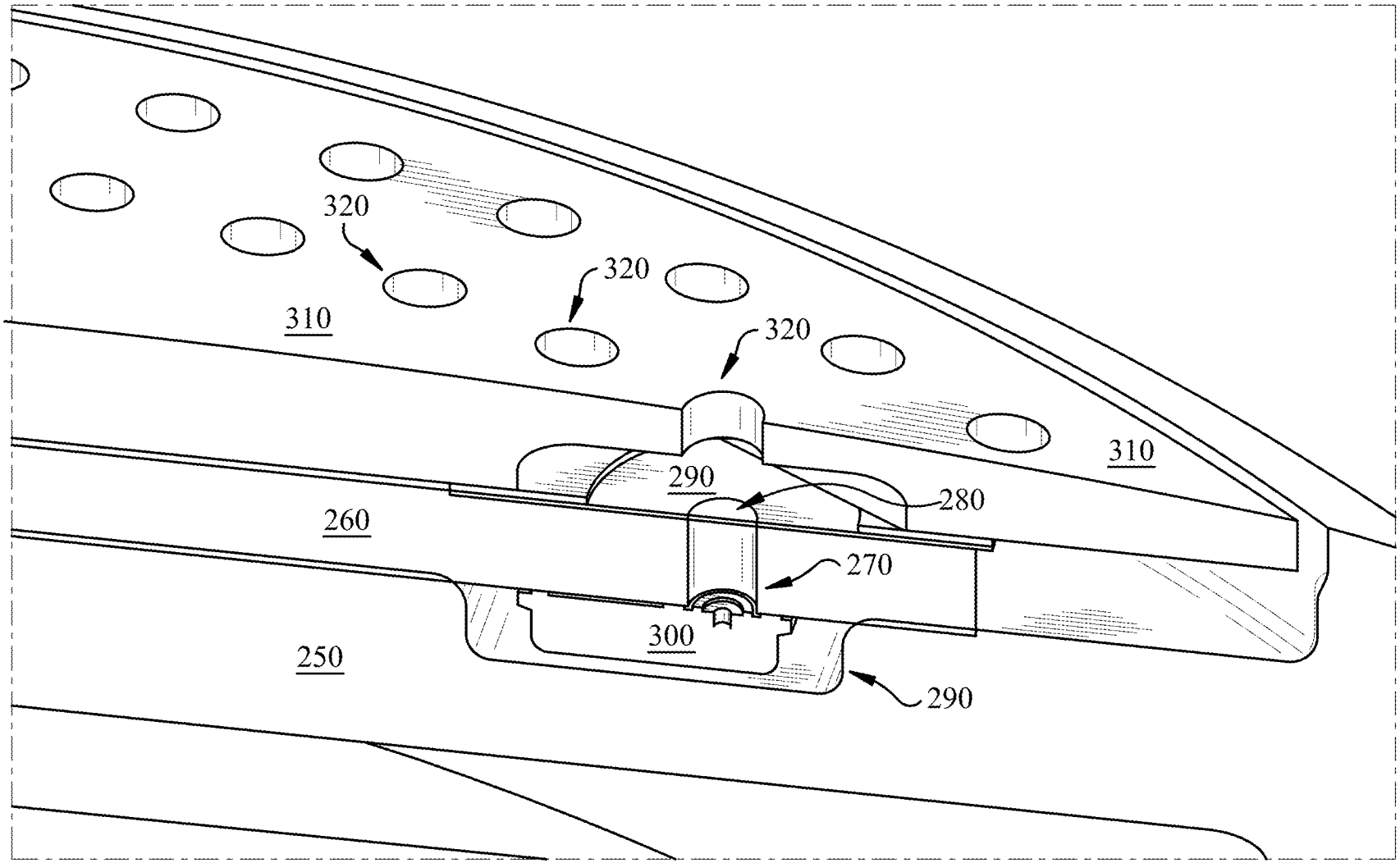
FIG. 8 shows a perspective view of the section of FIG. 7.

FIG. 7 illustrates a cross-sectional view of the printed wiring board 260 and a portion of the core section 250, and further illustrates a recess 290 in the core section 250 for accommodating a microphone 300 from the array 10 (FIG. 1). As can be seen in this view, the microphone 300 can include a surface mount component, which can be mounted to the bottom of the printed wiring board 260 (e.g., via conventional soldering paste connection) and sit at least partially housed within recess 290. In some cases, one or more microphone(s) 300 include a surface mounted micro-electro-mechanical systems (MEMS) microphone. In various implementations, the printed wiring board 260 can be located between each microphone 300 and a top section of the housing 210 (e.g., between interface 230 and microphone(s) 300, FIG. 2 and FIG. 4). As can be seen in FIG. 7 and FIG. 8, the acoustically transparent screen 280 can be located between the printed wiring board 260 and that top section (220A, FIG. 1) of the housing 210 (e.g., between interface 230 and printed wiring board 260, FIG. 2 and FIG. 4).

In various implementations, as shown in FIG. 7 and FIG. 8, the speaker system 200 can further include a top cap 310 between the printed wiring board 260 and the top section of the housing 210. Top cap 310 may form part of the housing 210 in various implementations. This top cap 310 can include a plurality of apertures 320 for permitting sound to pass to microphones 300. In some implementations, top cap 310 can be formed of a rigid material, e.g., a molded plastic.

Figure 9:
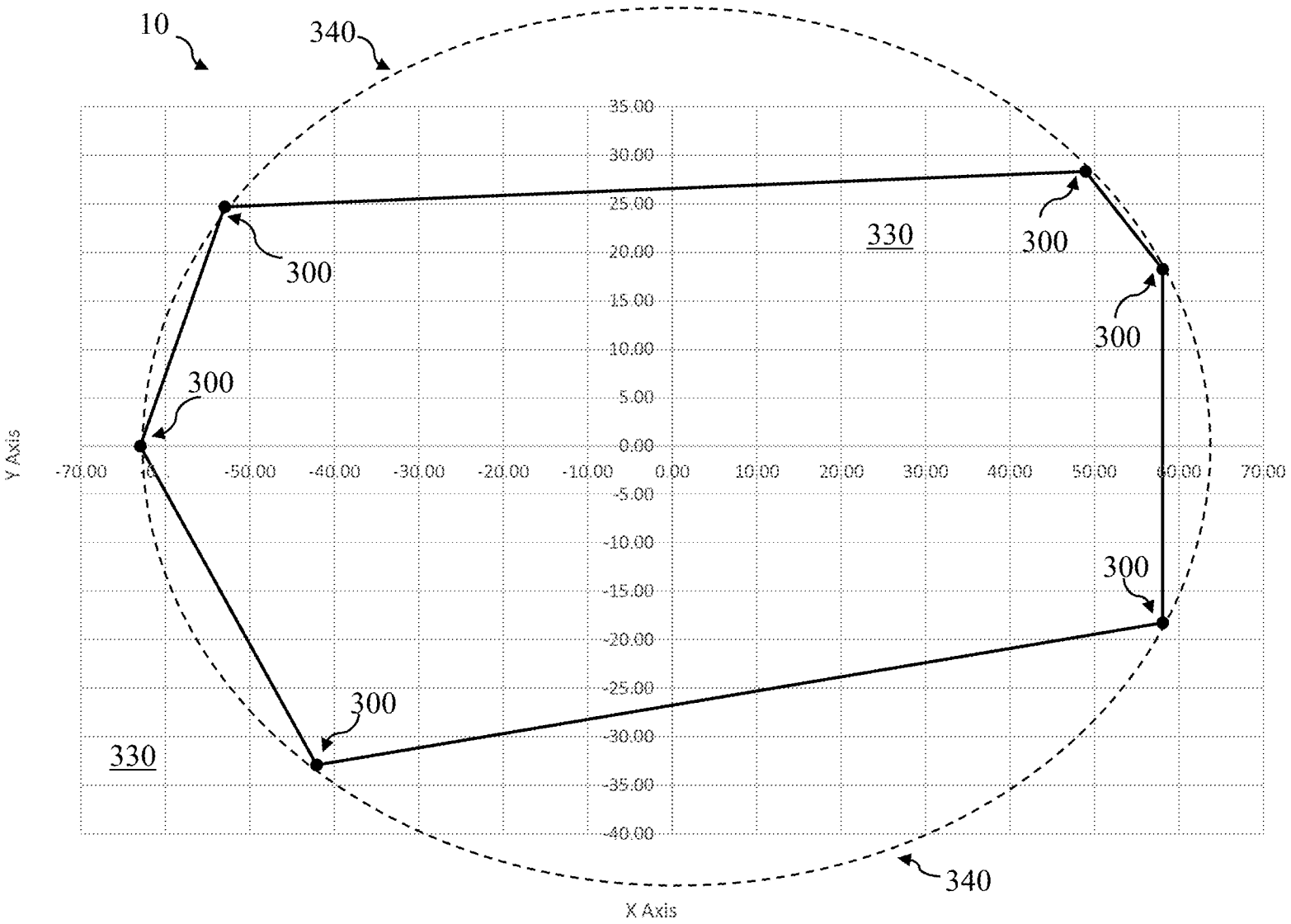
FIG. 9 is a graphical plot illustrating locations for microphones in an array within a housing according to various implementations.

FIG. 9 is a graphical plot depicting example locations of microphones 300 in the microphone array 10 according to various implementations. These example locations are also illustrated in the depictions of the microphone array 10 in FIGS. 4-6, however, it is understood that this example depiction is only one of many configurations of microphones according to various implementations. In particular, as shown in FIG. 9, the microphone array 10 has an asymmetric configuration of microphones 300. That is, the array 10 has a set of (e.g., two or more) microphones 300 positioned in a single plane 330 (perpendicular to primary Z axis), which are axially asymmetric with respect to both the primary X axis and the primary Y axis (FIG. 3). More particularly, with respect to each of the primary X axis and the primary Y axis, the microphones 300 are positioned asymmetrically. Additionally, the microphones 300 are positioned asymmetrically with respect to the azimuth angle (i.e., not evenly distributed in the azimuth angle). In the example implementation illustrated in FIG. 9, the array 10 includes six (6) microphones 300. However, it is understood that an array 10 can include a set of two or more microphones 300 according to various implementations. In some particular implementations, the array 10 includes a set of two, three, four or five microphones 300. Additional numbers of microphones 300 are also possible in other implementations. In certain cases, as described herein, the set of microphones 300 includes six microphones 300, which may effectively provide a directivity index substantially equal to an array with a greater number of microphones.

In some example implementations, the microphones 300 can be positioned in an axially asymmetric pattern with respect to both the primary X axis and the primary Y axis, but can be rotationally symmetric about the Z axis. That is, the microphones 300 in the array 10 can be positioned such that a full rotation about the Z axis results in two or more matching positions to an original position, e.g., an order of two (2) or more.

In other example implementations, the microphones 300 can be positioned asymmetrically with respect to both the primary X axis and the primary Y axis, and can additionally be rotationally asymmetric about the Z axis. In these cases, a complete rotation about the Z axis only results in one matching position (i.e., the original position), or an order of one (1).

As illustrated in FIG. 9 (and also shown in FIGS. 2-6), in some example implementations, a cross-section of the housing 210 along the single plane 330 (i.e., perpendicular to the Z axis) is a non-circular shape. That is, in the example implementation shown in FIGS. 2-6, the housing 210 has an ellipsoidal cross-section with a distinct length along the X axis than along the Y axis.

Figure 10:
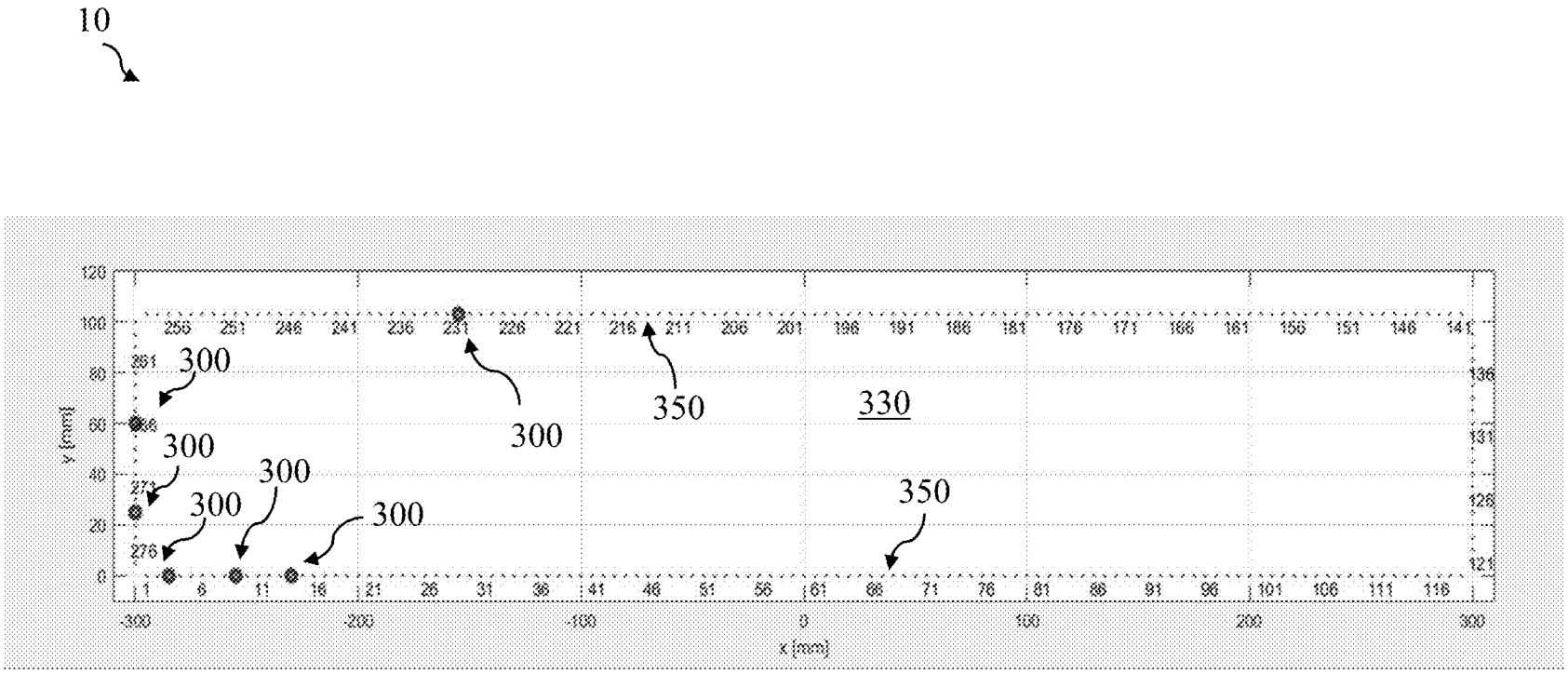
FIG. 10 is a graphical plot illustrating the array locations of FIG. 9, within an additional implementation of a housing.

In an additional example implementation, as shown in the graphical depiction of FIG. 10, a housing (shown as its perimetric boundary line 350) can also have a substantially rectangular shape within the single plane 330. That is, according to various implementations, the cross-section of a housing (e.g., with perimetric boundary line 350) can have a non-circular shape that is substantially rectangular (e.g., allowing for nominal contours and edge features). In these cases, the microphone array 10 can still include microphones 300 positioned asymmetrically with respect to both the primary X axis and the primary Y axis, and either rotationally symmetric about the Z axis or rotationally asymmetric about the Z axis. It is understood that in the implementations where a housing (e.g., housing with perimetric boundary line 350) is substantially rectangular in cross-sectional shape, other features of the speaker system can additionally be modified to accommodate this shape (e.g., a core section or printed wiring board may be shaped to complement the housing shape).

As described with reference to FIG. 1, the microphone array 10 receives a voice input 20 from the user 30 in order to form beams (e.g., formed beams 70, filtered beams 80) for processing commands from the user 30. Some conventional (also referred to as "reference") microphone arrays use arrays of microphones that are symmetric about at least one of a primary X axis or a primary Y axis of a housing and/or are symmetric about a perimetric boundary line of the housing. In particular, these reference microphone arrays conventionally include an array of microphones spaced equally from the perimetric boundary line and also symmetrically about at least one of the X axis or the Y axis of the housing. Additionally, these reference microphone arrays are conventionally spaced equally in azimuthal angle on a housing (e.g., a circular cross-sectional housing). These reference microphone arrays commonly include a greater number of electrodes when compared with the arrays disclosed according to various implementations (e.g., array 10). For example, a reference microphone array includes eight (8) or more microphones positioned symmetric about at least one of a primary X axis or a primary Y axis of a housing and/or are symmetric about a perimetric boundary line of the housing. In some cases, this reference microphone array is located in a housing having a circular cross-sectional shape (e.g., in a plane perpendicular with its primary Z axis).

Figure 11:
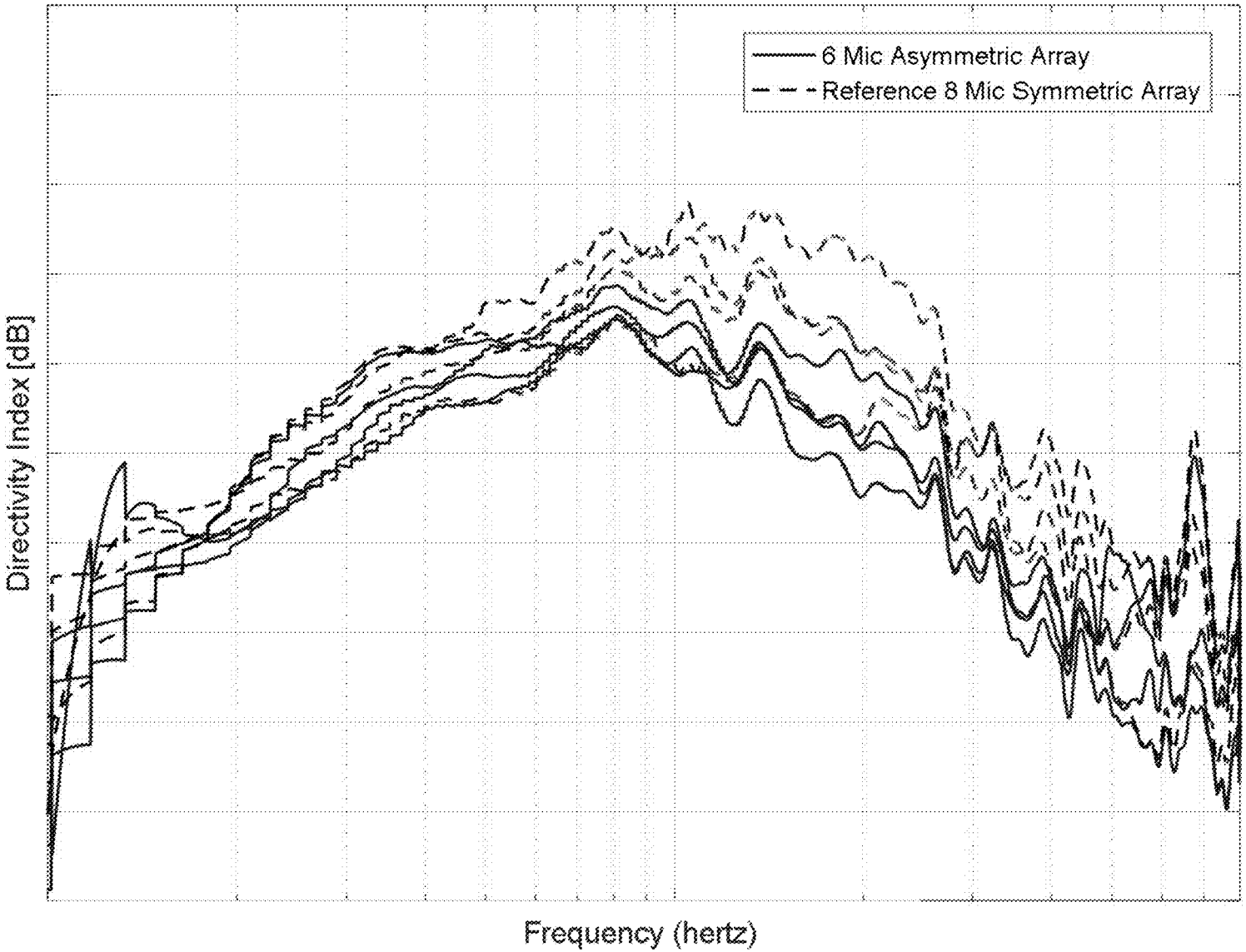
FIG. 11 is a graphical plot illustrating a comparison between a directivity index of beams formed from a microphone array according to various implementations when compared with beams formed from a reference microphone array.

The microphone array 10 disclosed according to various implementations can yield beams (e.g., formed beams 70, FIG. 1) with a directivity index that is substantially equal to a directivity index of beams formed from those reference arrays having symmetrical positioning about a perimetric boundary line. As used in this context, "substantially equal" can be within approximately 1 decibel (dB), over a significant portion of the voice region as a function of frequency. That is, the microphone array 10 disclosed according to various implementations can provide substantially equal directivity of voice input 20 as a reference array with a greater number of microphones. In particular implementations, the reference array includes at least one additional microphone not required by the microphone array 10 to achieve the substantially equal directivity index. In even further implementations, the microphone array 10 includes at least two fewer microphones than the reference array, while still providing beams with a substantially equal directivity index. FIG. 11 is a graphical plot illustrating the directivity index of the beams formed from microphone array 10 when compared with a set of reference arrays. As shown in this depiction, the directivity index of the first four beams formed from the microphone array 10 (with an example of six microphones 300) is plotted (in solid lines) with the directivity index of the first four beams formed from a reference microphone array (e.g., with an example of eight symmetrically arranged microphones, plotted in dashed lines). As is evident from this example graphical depiction, the directivity index of the beams formed from the microphone array 10 is substantially equal to the directivity index of the beams from the reference array, over a significant frequency range. Reducing the number of microphones relative to the reference array can provide for significant cost savings, increased computational efficiency in beam formation, and improved manufacturability. For example, some microphone types are prone to failure from mishandling, dust, etc., and reducing the number of microphones in an array can reduce the likelihood of these and other failures.

Additionally, the microphone array configurations disclosed according to various implementations can be used to adapt an array in a circular (cross-sectional) housing to a non-circular (cross-sectional) housing, such as a housing have an elliptical shape or rectangular shape in order to provide beams with a substantially equivalent directivity index.

Locations of microphones (e.g., microphones 300 in the array 10) can be based upon known locations of interference between voice input(s) 20, environmental sounds, and the physical construction of the speaker system (e.g., speaker system 200). That is, this asymmetric configuration of microphones 300 in the array 10 can be based at least in part upon a consistency in directivity index across all beams formed from the audio input at microphones 300 in the array 10. In some cases, the number of beams formed from microphone inputs is fixed, and can be used to iteratively calculate directivity index for all beams at a plurality of positions. According to some example implementations, twelve (12) beams are formed using the array 10. Locations of microphones can be based upon an acceptable deviation in directivity index from a reference array, such as an array generating twelve beams with equally azimuthal spaced microphones (e.g., at look directions every 30 degrees around a circle). In a particular example, microphone locations are determined such that a plane wave arriving at each microphone 300 from any direction will have different path lengths, such that the magnitude and phase differences between the microphones 300 support beamforming for each desired look direction.

Additionally, acoustic shadowing resulting from sound scattered off of a housing having a distinct cross-sectional shape from its corresponding microphone array can negatively affect beamforming, e.g., where an azimuthal symmetrical arrangement of microphones is employed in non-circular housing. As such, the asymmetric configuration of microphones 300 in array 10 (within a non-circular housing) can enhance beamforming when compared with the conventional, symmetrical array within a non-circular housing.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A microphone array mounted in a speaker housing having a primary X axis, a primary Y axis perpendicular to the primary X axis, and a primary Z axis perpendicular to the primary X axis and the primary Y axis, the microphone array comprising:

a set of microphones positioned in a single plane perpendicular to the primary Z axis of the speaker housing and axially asymmetric with respect to both the primary X axis of the speaker housing and the primary Y axis of the speaker housing, wherein all microphones in the set of microphones are stationary relative to the speaker housing, wherein the speaker housing has a horizontal cross-section that is non-circular in shape, wherein the set of microphones is rotationally asymmetric about the primary Z axis of the housing, wherein the single plane is parallel with the primary X axis and the primary Y axis, wherein a complete rotation of the set of microphones, in the single plane and about the Z axis, only results in one matching position, and wherein the set of microphones are positioned to enhance a directivity index of several beams with distinct look directions, and wherein magnitude and phase differences between the microphones in the set of microphones support beamforming for each of a plurality of look directions.

2. The microphone array of claim 1, further comprising a printed wiring board coupled to the set of microphones.

3. The microphone array of claim 1, wherein the set of microphones comprises at least two microphones.

4. The microphone array of claim 3, wherein the set of microphones comprises six microphones.

5. The microphone array of claim 1, wherein the set of microphones are positioned asymmetrically with respect to an azimuth angle in the single plane.

6. A system comprising:

a speaker housing having a primary X axis, a primary Y axis perpendicular to the primary X axis, and a primary Z axis perpendicular to the primary X axis and the primary Y axis; and a microphone array contained within the speaker housing, the microphone array having a set of microphones positioned in a single plane perpendicular to the primary Z axis of the speaker housing and axially asymmetric with respect to both the primary X axis of the housing and the primary Y axis of the speaker housing, wherein all microphones in the set of microphones are stationary relative to the speaker housing, wherein the speaker housing has a horizontal cross-section that is non-circular in shape, wherein the set of microphones is rotationally asymmetric about the primary Z axis of the speaker housing, wherein the single plane is parallel with the primary X axis and the primary Y axis, wherein a complete rotation of the set of microphones, in the single plane and about the Z axis, only results in one matching position, and wherein the set of microphones are positioned to enhance a directivity index of several beams with distinct look directions, and wherein magnitude and phase differences between the microphones in the set of microphones support beamforming for each of a plurality of look directions.

7. The system of claim 6, wherein the microphone array further comprises a printed wiring board coupled with the set of microphones.

8. The system of claim 7, further comprising a core section contained within the speaker housing, wherein the printed wiring board is coupled with the core, and wherein the core includes a set of recesses each at least partially housing one of the set of microphones.

9. The system of claim 7, wherein the printed wiring board is located between the set of microphones and a top section of the speaker housing, the printed wiring board further comprising a set of apertures extending therethrough for receiving the set of microphones.

10. The system of claim 9, further comprising an acoustically transparent screen between the printed wiring board and the top section of the speaker housing.

11. The system of claim 6, wherein the set of microphones are positioned asymmetrically with respect to an azimuth angle in the single plane.

12. A system comprising:

a speaker housing having a primary X axis, a primary Y axis perpendicular to the primary X axis, and a primary Z axis perpendicular to the primary X axis and the primary Y axis, wherein the speaker housing has a horizontal cross-section that is non-circular in shape;

a microphone array contained within the speaker housing, the microphone array comprising:

a set of microphones positioned in a single plane perpendicular to the primary Z axis of the housing and axially asymmetric with respect to both the primary X axis of the housing and the primary Y axis of the housing, wherein the set of microphones is rotationally asymmetric about the primary Z axis of the housing, wherein the single plane is parallel with the primary X axis and the primary Y axis, wherein a complete rotation of the set of microphones, in the single plane and about the Z axis, only results in one matching position, and wherein the set of microphones are positioned to enhance a directivity index of several beams with distinct look directions, and wherein magnitude and phase differences between the microphones in the set of microphones support beamforming for each of a plurality of look directions; and a printed wiring board coupled with the set of microphones; and a core section contained within the speaker housing, wherein the printed wiring board is coupled with the core, wherein the core includes a set of recesses each at least partially housing one of the set of microphones.

13. The system of claim 12, wherein the printed wiring board is located between the set of microphones and a top section of the speaker housing, the printed wiring board further comprising a set of apertures extending therethrough for receiving the set of microphones.

14. The system of claim 12, wherein the set of microphones comprises six microphones.

15. The system of claim 12, wherein the housing has an ellipsoidal cross-section having length along the primary X axis that is distinct from a length along the primary Y axis.

* * * * *